US007097375B1

(12) United States Patent
Bui et al.

(10) Patent No.: US 7,097,375 B1
(45) Date of Patent: Aug. 29, 2006

(54) MECHANICAL PENCIL HAVING A ROTATABLE WHEEL FOR ADVANCING LEAD

(75) Inventors: Cuong Phu Bui, Agoura, CA (US); Jack McGrath, Malibu, CA (US)

(73) Assignee: Jakks Pacific, Inc., Malibu, CA (US)

( * ) Notice: Subject to any disclaimer, the term of this patent is extended or adjusted under 35 U.S.C. 154(b) by 0 days.

(21) Appl. No.: 11/315,671

(22) Filed: Dec. 20, 2005

(51) Int. Cl.
*B43K 21/22* (2006.01)

(52) U.S. Cl. ..... 401/92; 401/93; 401/65

(58) Field of Classification Search ..... 401/55, 401/65–67, 82, 83, 92–94

See application file for complete search history.

(56) References Cited

U.S. PATENT DOCUMENTS 3,495,292 A * 2/1970 Giba et al. ..... 15/433
3,989,392 A * 11/1976 Seidler ..... 401/66
6,607,324 B1 * 8/2003 Choi ..... 401/55

* cited by examiner

*Primary Examiner*—Justine R. Yu
*Assistant Examiner*—Huyen Le
(74) *Attorney, Agent, or Firm*—Tope-McKay & Associates

(57) ABSTRACT

A mechanical pencil is described. The mechanical pencil includes a grip barrel with a slide member to hold a piece of lead. A wheel is rotatably mounted in the grip barrel around a wheel axis, such that a portion of the wheel extends through and beyond an opening in the grip barrel. A gear is attached with the wheel for sliding the slide member that is slide-ably disposed within the grip barrel. A chuck is connected with the slide member such that a user may roll the wheel to force the chuck to push lead from the lead chamber and out of the grip barrel, thereby allowing the user to control advancement of the lead from the mechanical pencil.

18 Claims, 11 Drawing Sheets

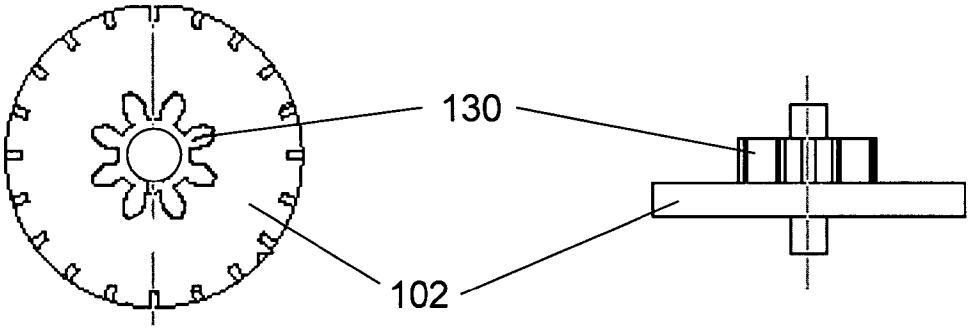
FIG. 5A
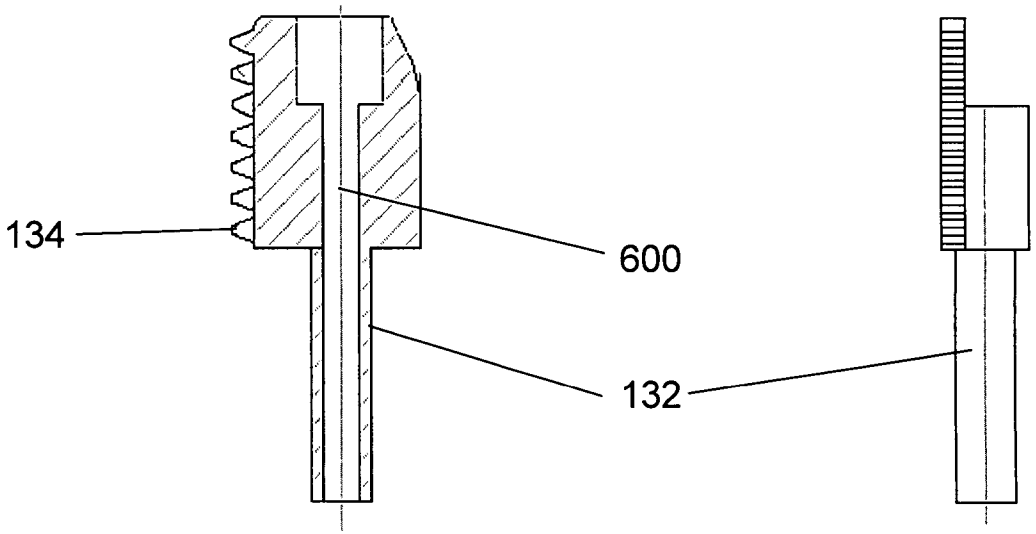
FIG. 5B
FIG. 6A
FIG. 6B

MECHANICAL PENCIL HAVING A ROTATABLE WHEEL FOR ADVANCING LEAD

PRIORITY CLAIM

The present application is a non-provisional patent application, claiming the benefit of priority of U.S. Design Application No. 29/242,875, filed on Nov. 15, 2005, entitled, "Mouse Touch Roller Pencil."

BACKGROUND OF THE INVENTION (1) Field of Invention

The present invention relates to a mechanical pencil and, more particularly, to a mechanical pencil that includes a wheel to advance the lead disposed within the mechanical pencil.

(2) Description of Related Art

Mechanical pencils have long been known in the art. A multitude of barrel-shaped mechanical pencils have been devised that include an actuation means, where upon actuation, lead disposed within the pencil is advanced beyond an end of the barrel, thereby allowing a user to control the amount of lead being exposed to write upon a surface. By way of example, mechanical pencils have typically been formed using three types of mechanisms, a side-knock mechanism, a push-button mechanism, and a rotary-knock mechanism.

Side-knock mechanical pencils typically include a barrel having an opening in a side wall. A knock lever is mounted within the opening and pivotally mounted with respect to the barrel. The knock lever is connected with a chuck mechanism such that by depressing the lever, the chuck mechanism is opened to allow advancement of a piece of lead. A problem associated with such a pencil is that depressing the lever advances the lead in step-like equal increments, preventing a user from rolling the lead out in a smooth fashion.

Push-button mechanical pencils suffer from many of the same setbacks as side-knock mechanical pencils. Push-button pencils typically comprise a barrel with a push-button opposite a tip end. The push-button is connected with a lead chamber such that pressing the push-button causes the lead chamber to advance, thereby causing the lead to advance. The lead chamber is in an incrementally slide-able relationship to the barrel, such that the lead chamber is allowed to advance in a predetermined increment. Therefore, advancement of the lead is limited to the incremental movement of the lead chamber. As was the case with side-knock pencils, the lead in push-button pencils can only be advanced in predetermined increments.

Rotary-knock mechanical pencils include both forward and rearward outer cylinders. A cam-movement converting mechanism is stored in the forward cylinder to convert rotary movement of the rearward cylinder into an axial advancing movement. By rotating the rearward cylinder, lead is advanced forward to extend beyond the forward cylinder, thereby allowing a user to selectively advance and use the lead. While such mechanisms are not limited to the incremental advancement of the lead, they include multiple and complex parts which may be prone to breakage.

Thus, a continuing need exists for a mechanical pencil that relies on a simple mechanism to smoothly advance the lead without the incremental advancement mechanisms found in the prior art.

SUMMARY OF INVENTION

The present invention relates to a mechanical pencil. The mechanical pencil comprises a grip barrel having a pencil end, a proximal end, and an outer surface. The grip barrel also includes an opening in the outer surface. A wheel is rotatably mounted in the grip barrel around a wheel axis. The wheel is mounted such that a portion of the wheel extends through the opening and beyond the outer surface of the grip barrel. A chuck is disposed within the grip barrel such that lead placed in the mechanical pencil is directed through the chuck. A slide member for holding a piece of lead is slide-ably disposed within the grip barrel and operably connected with the wheel. The slide member is also operably connected with the chuck such that rolling the wheel causes the slide member to move forward and backward. Moving the slide member forward causes the chuck to advance the lead from the pencil end of the grip barrel. Alternatively, moving the slide member backward causes the chuck to slide backward and over the lead, thereby leaving advanced lead extending beyond the pencil end of the grip barrel.

The present invention further comprises a first gear attached with the wheel and rotatably mounted around the wheel axis. The first gear is operably connected with the chuck to allow a user to force the lead from the pencil end of the grip barrel. Additionally, a second gear is operably mounted within the grip barrel and positioned between the first gear and the slide member. The slide member further includes a portion having teeth for mating with the second gear, such that rolling the wheel causes the first gear to turn the second gear, which in turn causes the slide member to advance and force the lead out of the pencil.

Furthermore, a spring is attached with the slide member for forcing the slide member backwards after having been advanced by a user.

In another aspect, an eraser connector is formed at the proximal end for attachment of an eraser. Additionally, an eraser is attached with the eraser connector.

Finally, as can be appreciated by one in the art, the present invention also comprises a method for forming and using the mechanical pencil described herein.

BRIEF DESCRIPTION OF THE DRAWINGS

The objects, features and advantages of the present invention will be apparent from the following detailed descriptions of the various aspects of the invention in conjunction with reference to the following drawings, where:

FIG. 5A is a side-view illustration of a wheel and attached gear according to the present invention;

FIG. 5B is a top-view illustration of the wheel and attached gear according to the present invention;

FIG. 6A is a side-view illustration of a slide member according to the present invention;

FIG. 6B is a top-view illustration of a slide member according to the present invention;

DETAILED DESCRIPTION

The present invention relates to a mechanical pencil and, more particularly, to a mechanical pencil that includes a wheel to advance the lead disposed within the mechanical pencil. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

(1) Description

Figure 1:
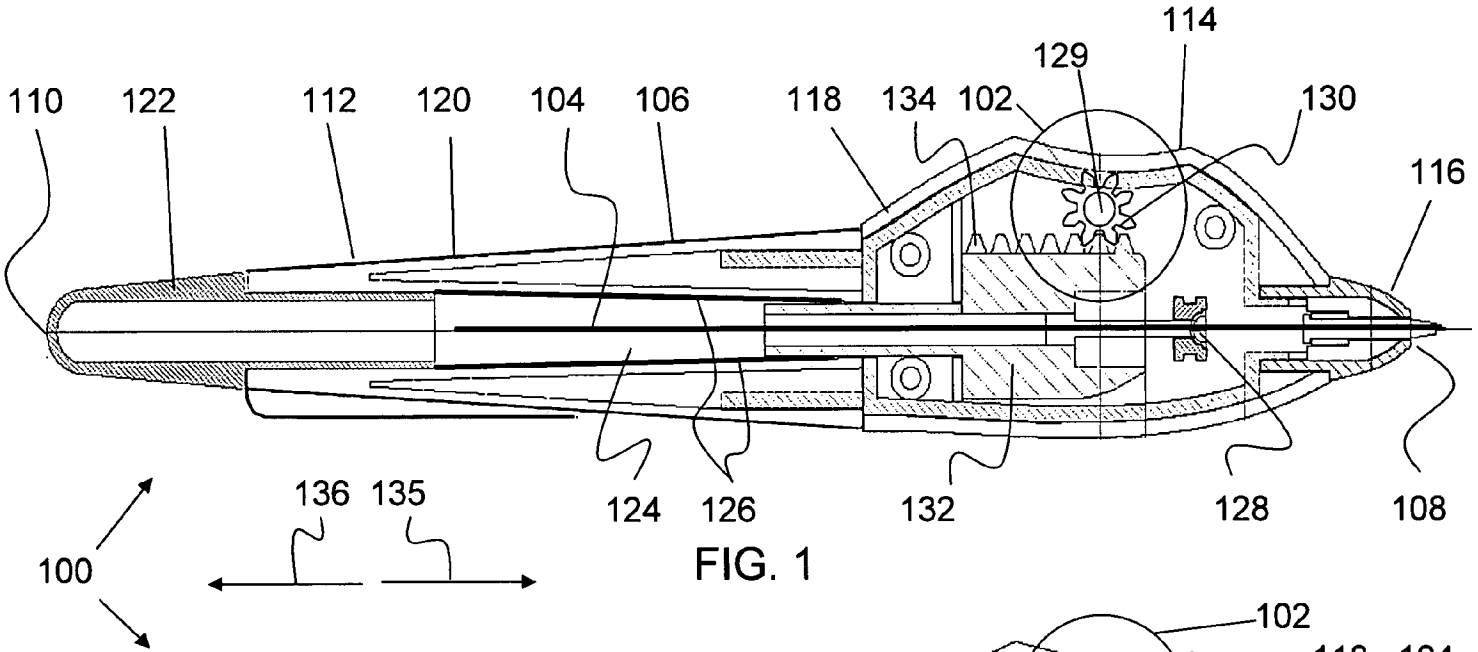
FIG. 1 is a cross-sectional side-view illustration of a mechanical pencil according to the present invention, illustrating a slide member in a rearward position.

Typical mechanical pencils include a knock mechanism that results in an incremental advancement of lead. The present invention improves on the prior art by disclosing a pencil that provides a non-incremental, smooth advancement of lead. As shown in FIG. 1, the present invention relates to a mechanical pencil 100 that includes a wheel 102 to smoothly advance the lead 104 disposed within the mechanical pencil 100. As can be appreciated by one skilled in the art, the lead 104 described herein is used for illustrative purposes and is not intended to be limited to actual lead. As such, the lead described in the present invention is any suitable writing material that operates with the mechanical pencil 100, non-limiting examples of which include lead, graphite, and wax.

The mechanical pencil 100 comprises a grip barrel 106 having a pencil end 108, a proximal end 110, and an outer surface 112. An opening 114 is formed through the grip barrel to the outer surface 112. The grip barrel 106 is formed of a suitably durable material, non-limiting examples of which include plastic and metal. The grip barrel 106 may be formed of a plurality of parts, such as a tip 116, a case 118, a rack 120, and a cap 122. Each part is connected with its corresponding neighbor part through any suitable connection technique, non-limiting examples of which include adhesives and corresponding threads. As can be appreciated by one in the art, although the grip barrel 106 is being described as having a plurality of parts, it is not limited thereto. The grip barrel 106 can be formed of a single part or of any variance of the plurality of parts. As a non-limiting example, the tip 116, case 118, and rack 120 may be formed as a single grip barrel piece, with the cap 122 being detachably attached with the rack 120 portion of the grip barrel 106.

A lead chamber 124 is formed in the grip barrel 106 to hold a piece of lead 104. The lead chamber 124 is formed such that it has a tapered end 126 for channeling the lead 104 towards a chuck 128. Removing the cap 122 provides access to the lead chamber 124, allowing a user to place lead 104 within the lead chamber 124 and thereby fill and/or refill the mechanical pencil 100.

A wheel 102 is rotatably mounted in the grip barrel 106 around a wheel axis 129. The wheel 102 is mounted such that a portion of the wheel 102 extends through the opening 114 and beyond the outer surface 112 of the grip barrel 106. A first gear 130 is attached with the wheel 102 and rotatably amounted around the wheel axis 129. The first gear 130 is attached with the wheel 102 such that as a user turns the wheel 102, the first gear 130 also turns.

A slide member 132 is slide-ably disposed within the grip barrel 106. The slide member 132 includes teeth 134 for mating with the first gear 130. The slide member 132 is connected with the first gear 130 such that rolling the wheel 102 turns the first gear 130, which causes the slide member 132 to move forward 135 and backward 136. As shown in FIG. 1, the slide member 132 is at rest in a backward 136 position.

Figure 2:
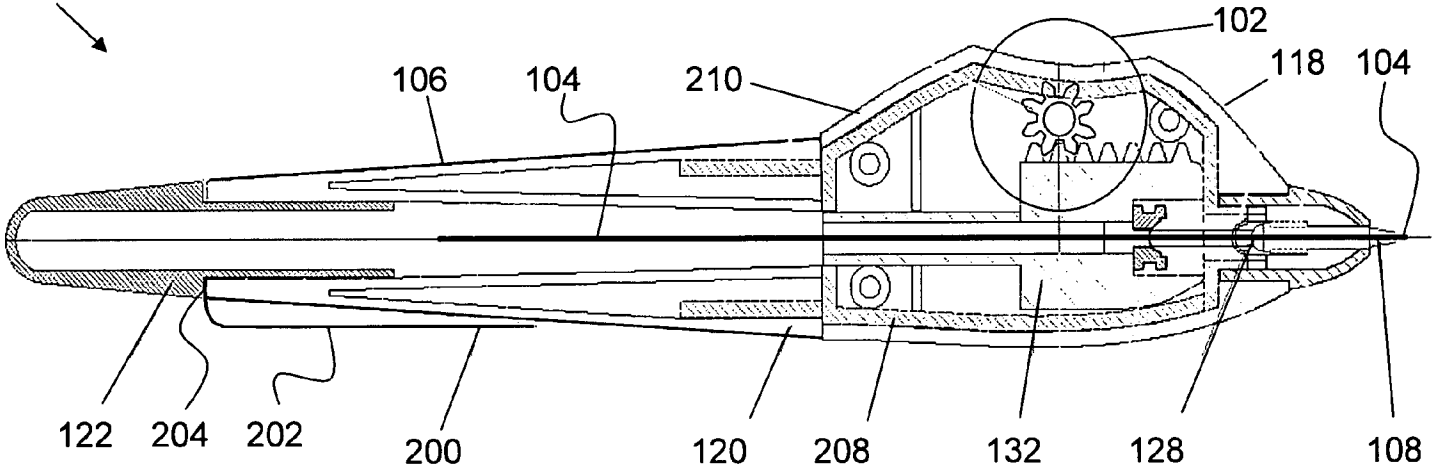
FIG. 2 is a cross-sectional side-view illustration of the mechanical pencil according to the present invention, illustrating the slide member in a forward position.

As shown in FIGS. 1 and 2, the slide member 132 is connected with the chuck 128 such that as the slide member 132 moves forward 135, it causes the chuck 128 to advance the lead 104 from the pencil end 108 of the grip barrel 106. Additionally, using the wheel 102 to cause the slide member 132 to move backward 136, causes the chuck 128 to be pulled backward 136 and over the lead 104, thereby leaving advanced lead 104 extending beyond the pencil end 108 of the grip barrel 106. The chuck 128 is described in further detail below.

Additionally, a pen holder 200 may be connected with the grip barrel 106. The pen holder 200 includes an elongated portion 202 for connecting with an object, and an attachment portion 204 that is attached with the grip barrel 106. The attachment portion 204 may be a ringlet that is sandwiched between the cap 122 and the rack 120.

Figure 3:
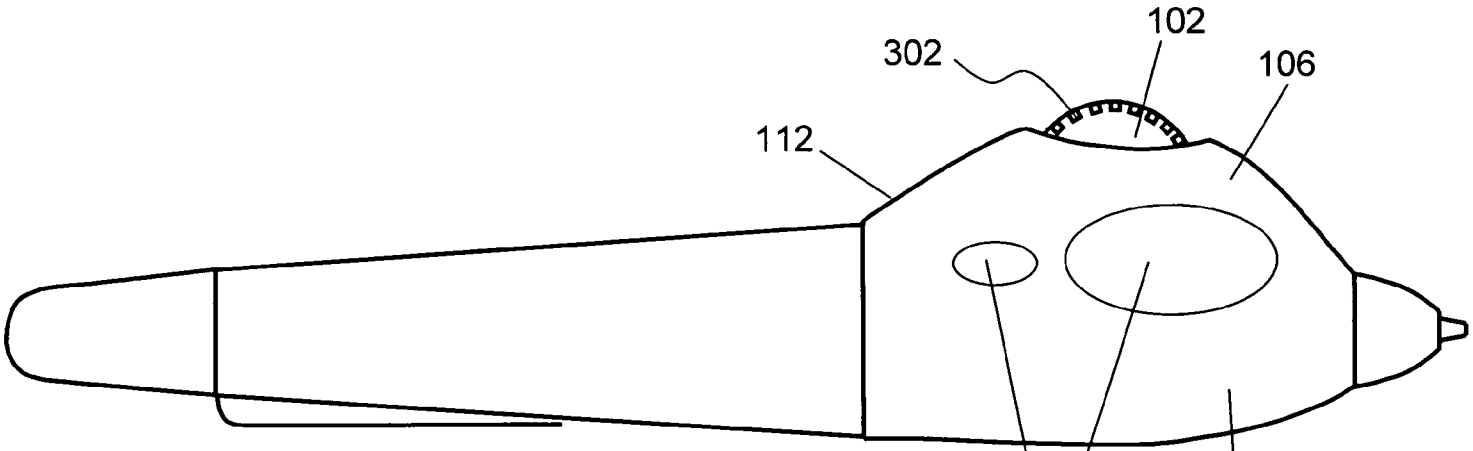
FIG. 3 is a side-view illustration of the mechanical pencil according to the present invention.
Figure 4:
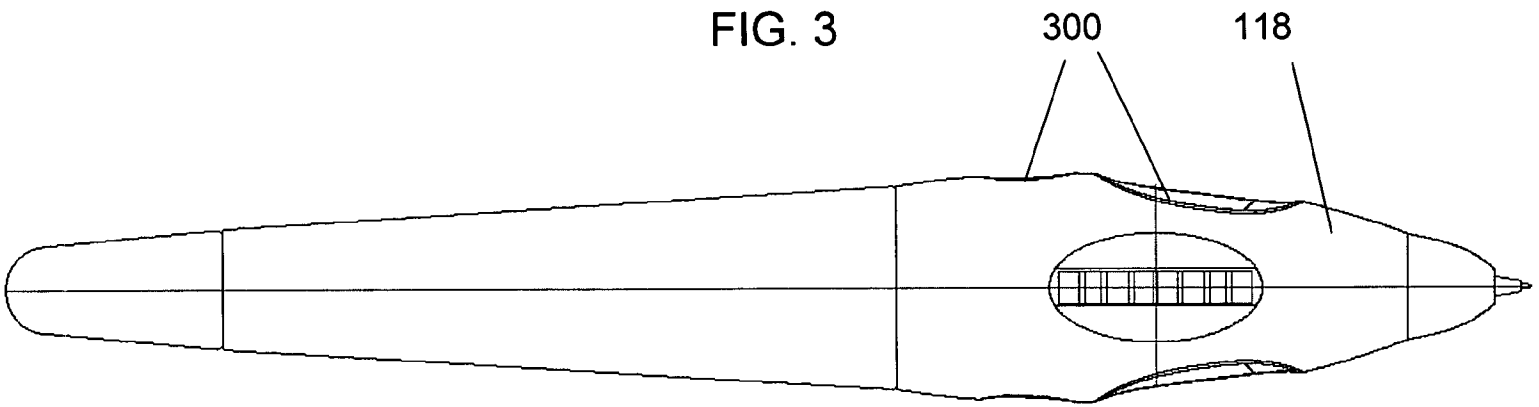
FIG. 4 is a top-view illustration of the mechanical pencil according to the present invention.

To increase comfort for a user, the case 118 may include a hard inner portion 208 and a soft outer portion 210. For example, the hard inner portion 208 may be formed of a hard plastic, while the soft outer portion 210 may be formed of a soft malleable rubber. Additionally, as shown in FIGS. 3 and 4, indentations 300 may be included in the case 118 to accommodate a user's fingers.

As noted above and as shown in FIG. 3, the wheel 102 is mounted such that a portion of the wheel 102 extends through the opening and beyond the outer surface 112 of the grip barrel 106. The wheel 102 is formed to be rolled by a user's finger, such as an index finger. Grooves 302 may be included in the wheel 102 to increase its gripping properties to assist a user in rolling the wheel 102.

For further illustration, FIG. 5A is a side-view of a wheel 102 with an attached first gear 130. As shown in the top-view illustration of FIG. 5B, the first gear 130 is offset to one side of the wheel 102 so that the first gear 130 alone engages with the teeth on the slide member.

As shown in FIG. 6A, the slide member 132 includes teeth 134 for engaging with the gear. The slide member 132 also includes a hollow cavity 600 for housing the chuck, and placement of lead therethrough.

Figure 7:
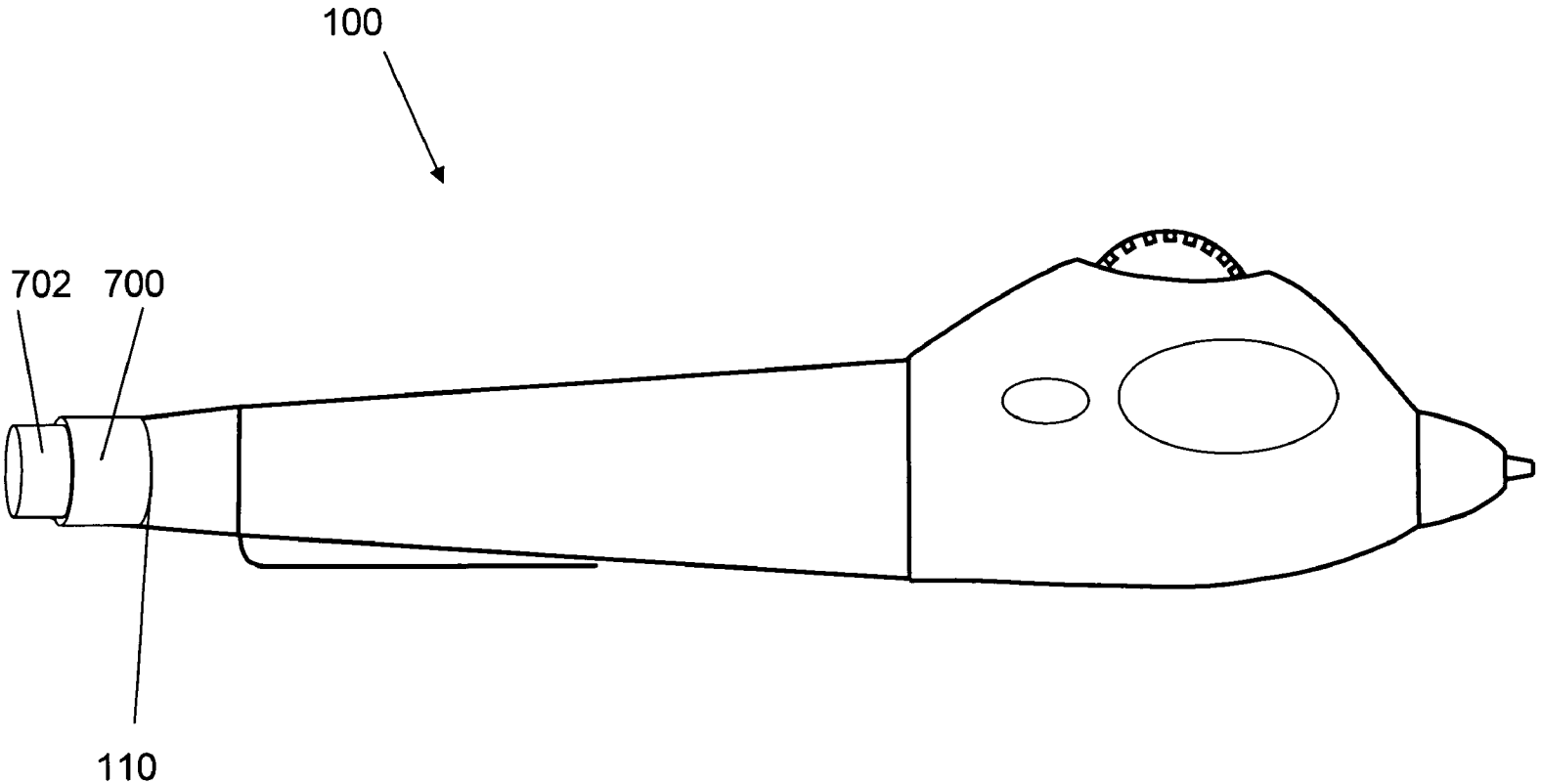
FIG. 7 is a side-view illustration of another aspect of the mechanical pencil according to the present invention, illustrating an eraser being connected with the mechanical pencil.

In another aspect, and as shown in FIG. 7, an eraser connecter 700 may be formed at the proximal end 110 of the mechanical pencil 100. An eraser 702 is attached with the eraser connector 700 to allow a user to erase lead that is disposed upon a surface. As can be appreciated by one in the art, the use of an eraser connector 700 and attached eraser 702 is an optional aspect and is not necessarily included in all embodiments.

Figure 8:
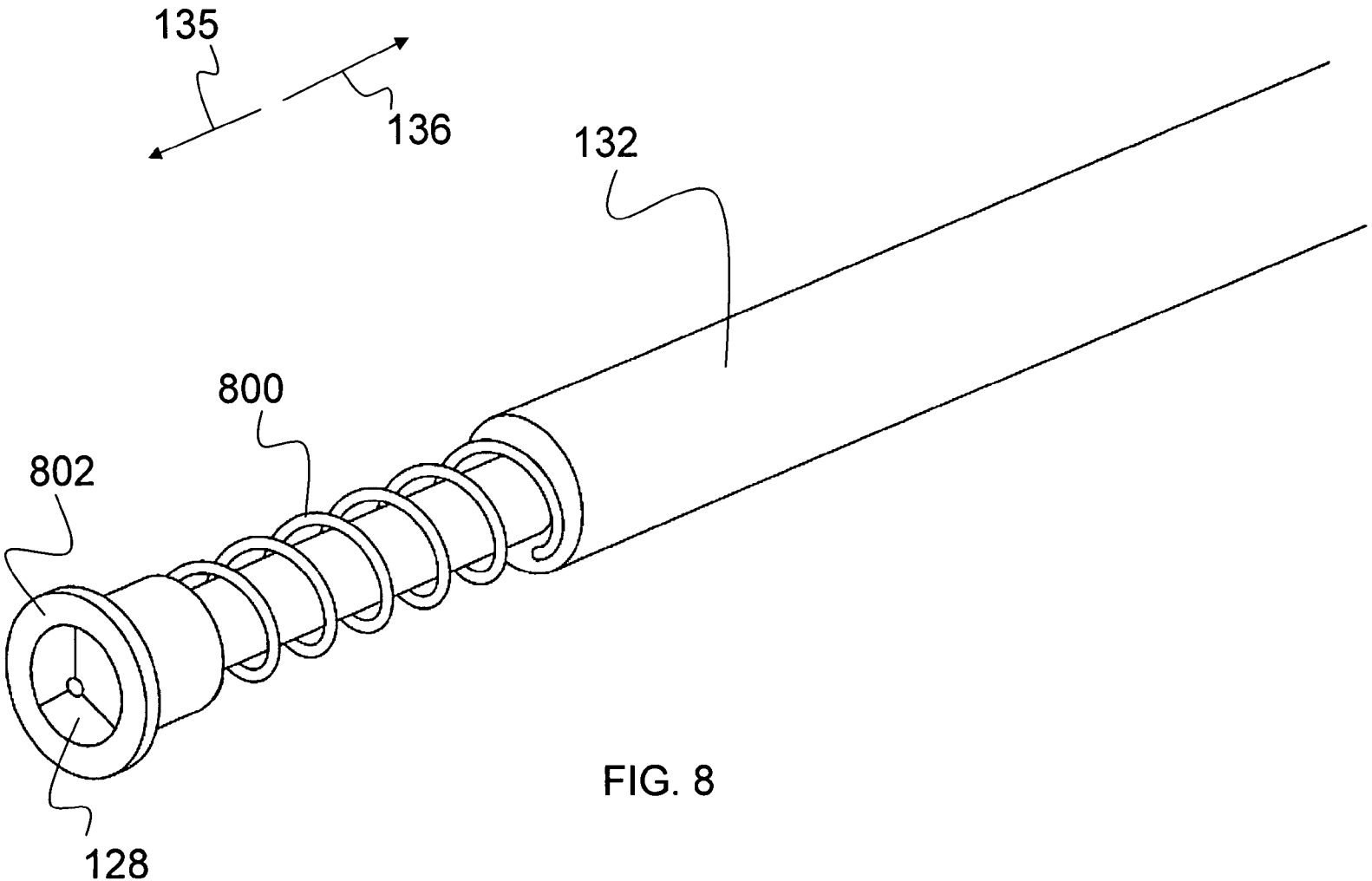
FIG. 8 is an illustration of a chuck mechanism according to the present invention, illustrating the chuck in a closed position.
Figure 9:
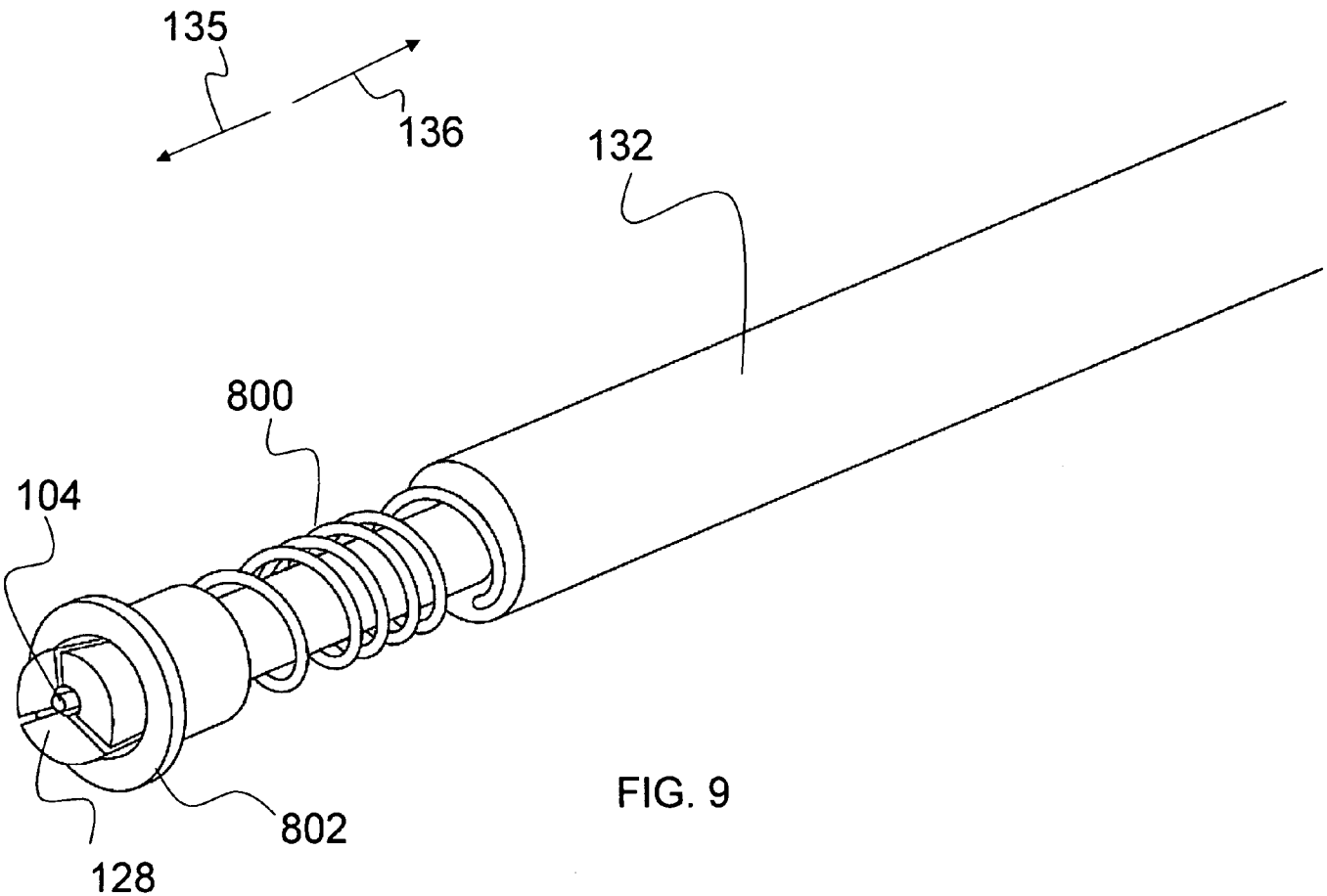
FIG. 9 is an illustration of a chuck mechanism according to the present invention, illustrating the chuck in an open position.

FIGS. 8 and 9 depict the chuck 128 mechanism. FIG. 8 illustrates the chuck 128 in a closed position, while FIG. 9 illustrates the chuck 128 in an open position. The chuck 128 is housed in a chuck housing 802 that is affixed within the pencil. As the slide member 132 moves forward 135, it causes the chuck 128 to advance from the chuck housing 802, thereby opening and advancing the lead 104. In addition to manually causing the slide member 132 to move backward 136 (as described above using the wheel), a spring 800 can be used to cause the chuck 128 retract into the chuck housing 802 and thereby leaving advanced lead 104.

In addition to the gearing mechanism described above, there are several other gearing configurations that can be used to cause the slide member 132 to move forward 135 and thereby interact with the chuck 128 to advance the lead 104.

Figure 10A:
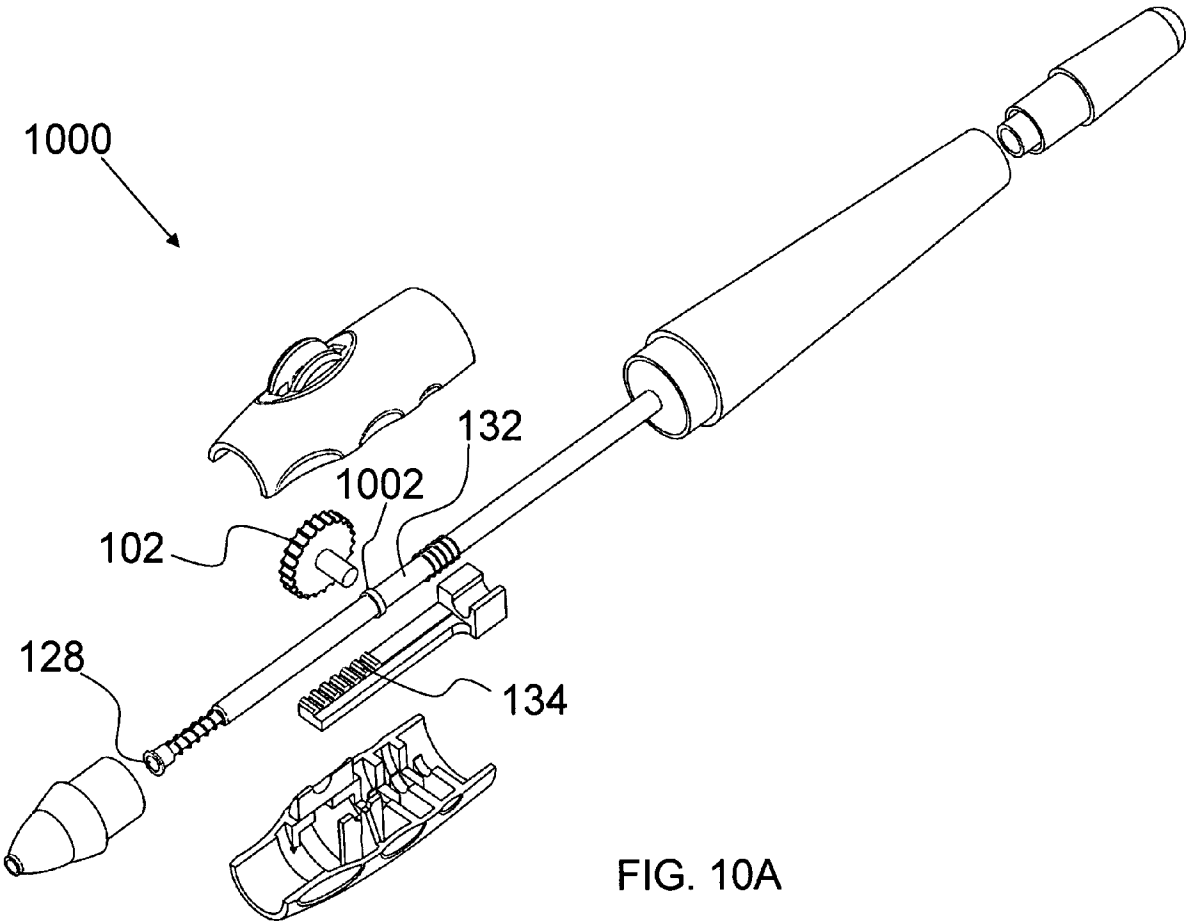
FIG. 10A is an illustration of a mechanical pencil according to the present invention.

For example, FIG. 10A illustrates another aspect of the mechanical pencil 1000. In this aspect, the slide member 132 and slide member teeth 134 are formed as two separate pieces that are connected with each other using a slide tab 1002.

Figure 10B:
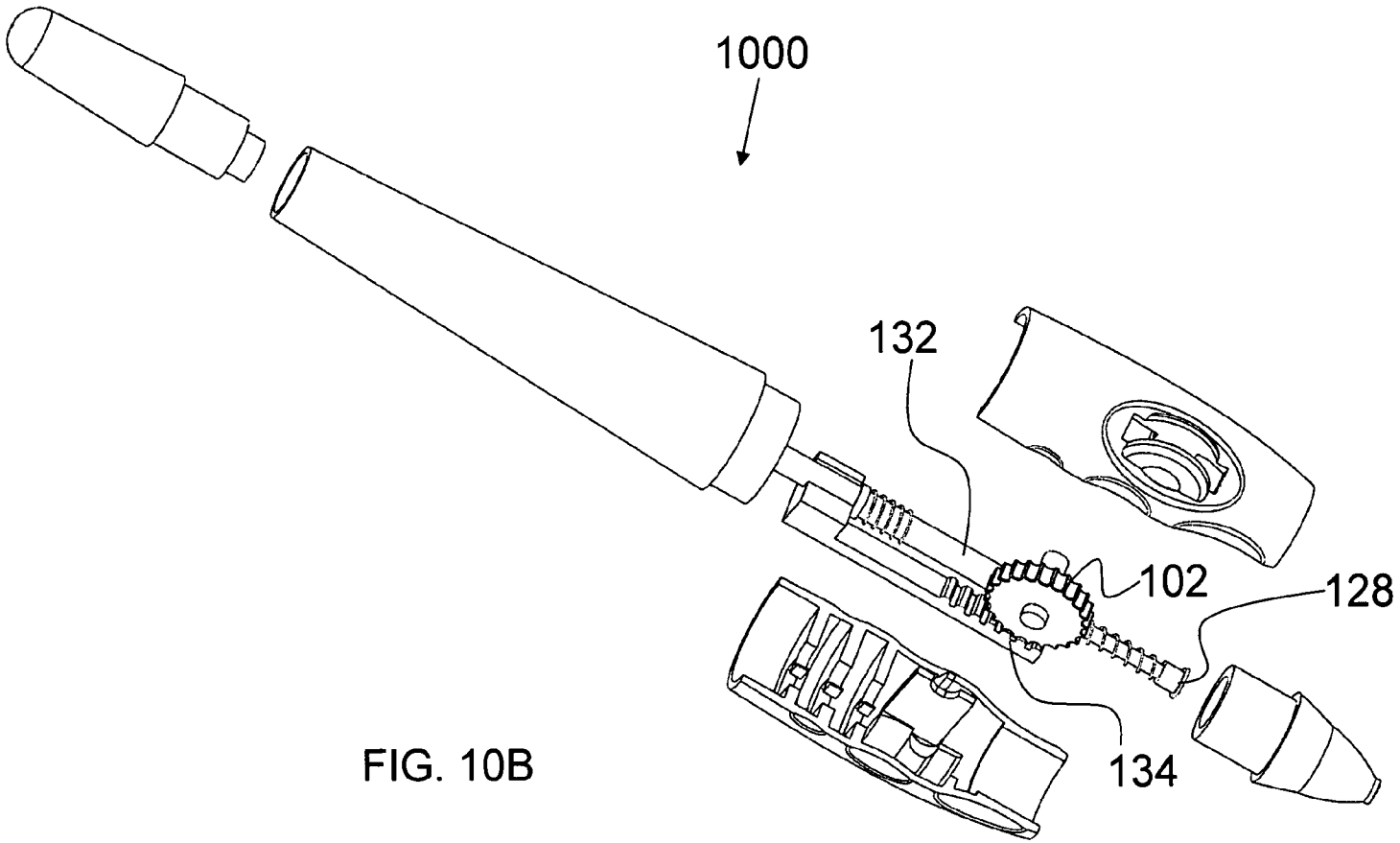
FIG. 10B is an illustration of the mechanical pencil according to the present invention.

FIG. 10B illustrates the mechanical pencil 1000 of FIG. 10A being further assembled. As seen in FIG. 10B, the wheel 102 in this aspect engages directly with the slide member teeth 134 to cause the slide member 132 to advance the chuck 128.

In the aspects described above, rolling the wheel 102 backwards causes the slide member 132 to slide forward. Alternatively, rolling the wheel 102 forwards causes the slide member 132 to slide backwards. To some users, such a configuration may be counterintuitive when rolling out lead.

Figure 11:
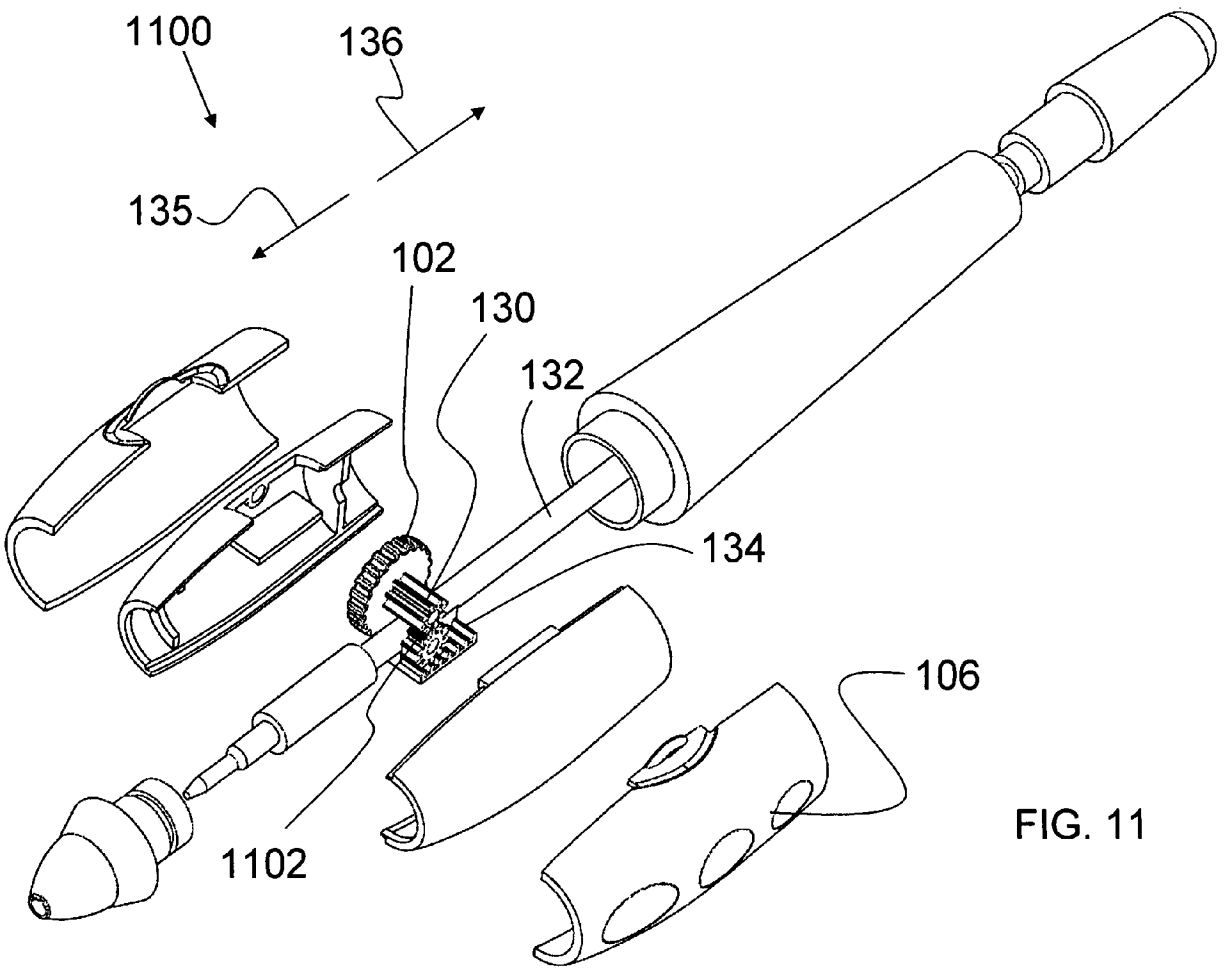
FIG. 11 is an illustration of a mechanical pencil according to the present invention.
Figure 12:
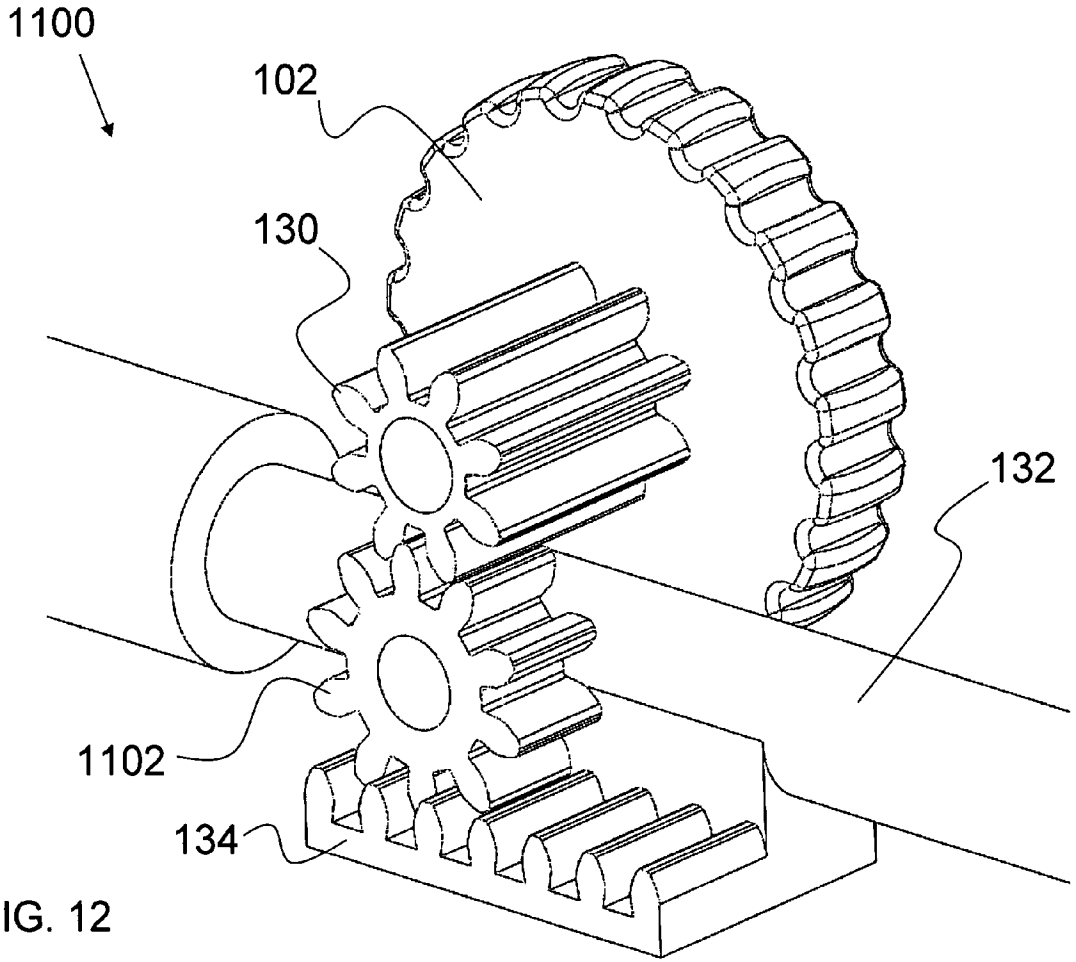
FIG. 12 is a blown-up illustration of the gearing configuration of the mechanical pencil depicted in FIG. 11.
Figure 13:
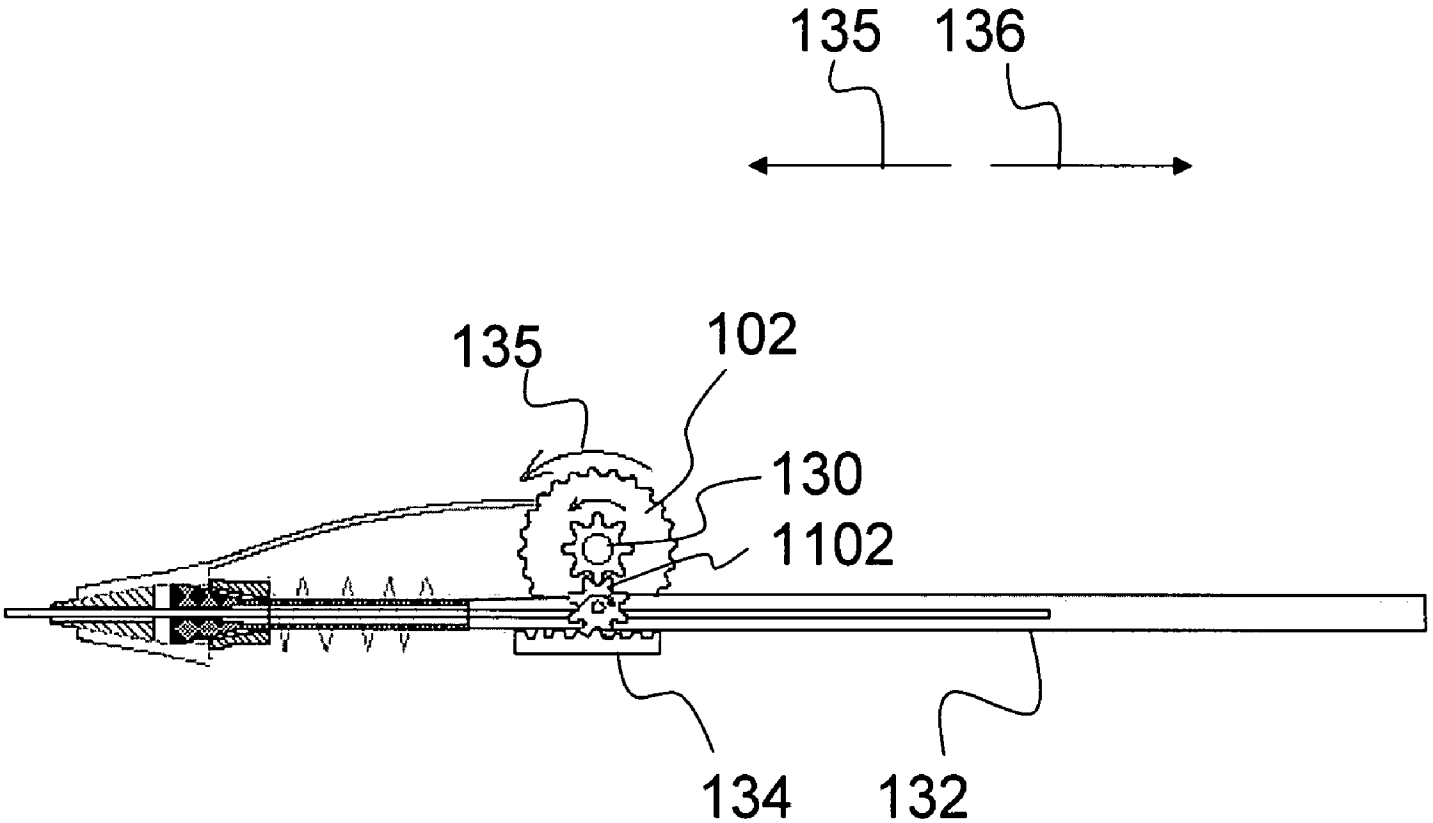
FIG. 13 is an internal, side-view illustration of the mechanical pencil depicted in FIG. 11.

As such, FIGS. 11, 12, and 13 illustrate another aspect of the mechanical pencil 1100, showing a gearing configuration where rolling the wheel 102 forward 135 causes the slide member 132 to slide forward 135. Thus, rolling the wheel 102 forward 135 causes the chuck to advance lead from the mechanical pencil 1100. FIG. 11 is an exploded view of the mechanical pencil 1100, FIG. 12 is a close-up view of the gearing configuration of the mechanical pencil 1100, and FIG. 13 is an internal, side-view of the mechanical pencil 1100, showing the gearing configuration in operation.

As shown in FIGS. 11, 12, and 13, the first gear 130 is attached with the wheel 102 and rotatably mounted around the first axis. A second gear 1102 is operably mounted within the grip barrel 106 and positioned between the first gear 130 and the slide member 132. To engage with the second gear 1102, the slide member 132 further includes a portion having teeth 134. Therefore, rolling the wheel 102 causes the first gear 130 to turn the second gear 1102, which in turn causes the slide member 132 to advance forward 135 and cause the chuck to force the lead out of the pencil 1100. As can be appreciated by one skilled in the art and as described above, a spring can be included to force the slide member 132 backwards 136 after the desired amount of lead is advanced.

What is claimed is:

1. A mechanical pencil, comprising:

a grip barrel including a pencil end, a proximal end, and an outer surface, the grip barrel having an opening in the outer surface;

a wheel rotatably mounted in the grip barrel around a wheel axis, such that a portion of the wheel extends into the opening such that is rotatable by a user;

a chuck disposed within the grip barrel such that lead placed in the mechanical pencil is directed through the chuck, a slide member for holding a piece of lead, the slide member being slide-ably disposed within the grip barrel and operably connected with the wheel, the slide member also being operably connected with the chuck such that rolling the wheel causes the slide member to move forward and backward, wherein moving the slide member forward causes the chuck to advance the lead from the pencil end of the grip barrel and moving the slide member backward causes the chuck to slide backward and over the lead, thereby leaving advanced lead extending beyond the pencil end of the grip barrel.

2. A mechanical pencil as set forth in claim 1, further comprising a first gear attached with the wheel and rotatably mounted around the wheel axis, the first gear being operably connected with the chuck to allow a user to force the lead from the pencil end of the grip barrel.

3. A mechanical pencil as set forth in claim 2, further comprising a second gear operably mounted within the grip barrel and positioned between the first gear and the slide member, and wherein the slide member further includes a portion having teeth for mating with the second gear, such that rolling the wheel causes the first gear to turn the second gear, which in turn causes the slide member to advance and force the lead out of the pencil.

4. A mechanical pencil as set forth in claim 3, further comprising a spring attached with the slide member for forcing the slide member backwards after having been advanced by a user.

5. A mechanical pencil as set forth in claim 4, further comprising an eraser connector formed at the proximal end for attachment of an eraser.

6. A mechanical pencil as set forth in claim 5, further comprising an eraser attached with the eraser connector.

7. A mechanical pencil as set forth in claim 1, further comprising a spring attached with the slide member for forcing the slide member backwards after having been advanced by a user.

8. A mechanical pencil as set forth in claim 1, further comprising an eraser connector formed at the proximal end for attachment of an eraser.

9. A mechanical pencil as set forth in claim 8, further comprising an eraser attached with the eraser connector.

10. A method for forming a mechanical pencil, comprising acts of:

forming a grip barrel to include a pencil end, a proximal end, and an outer surface, the grip barrel having an opening in the outer surface;

rotatably mounting a wheel in the grip barrel around a wheel axis, such that a portion of the wheel extends through the opening and beyond the outer surface;

disposing a chuck within the grip barrel such that lead placed in the mechanical pencil is directed through the chuck, slide-ably disposing a slide member within the grip barrel for holding a piece of lead, the slide member being operably connected with the wheel, the slide member also being operably connected with the chuck such that rolling the wheel causes the slide member to move forward and backward, wherein moving the slide member forward causes the chuck to advance the lead from the pencil end of the grip barrel and moving the slide member backward causes the chuck to slide backward and over the lead, thereby leaving advanced lead extending beyond the pencil end of the grip barrel.

11. A method for forming a mechanical pencil as set forth in claim 10, further comprising an act of attaching a first gear with the wheel such that it is rotatably mounted around the wheel axis, the first gear being operably connected with the chuck to allow a user to force the lead from the pencil end of the grip barrel.

12. A method for forming a mechanical pencil as set forth in claim 11, further comprising an act of operably mounting a second gear within the grip barrel such that it is positioned between the first gear and the slide member, and wherein the slide member further includes a portion having teeth for mating with the second gear, such that rolling the wheel causes the first gear to turn the second gear, which in turn causes the slide member to advance and force the lead out of the pencil.

13. A method for forming a mechanical pencil as set forth in claim 12, further comprising an act of attaching a spring with the slide member for forcing the slide member backwards after having been advanced by a user.

14. A method for forming a mechanical pencil as set forth in claim 13, further comprising an act of forming an eraser connector at the proximal end for attachment of an eraser.

15. A method for forming a mechanical pencil as set forth in claim 14, further comprising an act of attaching an eraser with the eraser connector.

16. A method for forming a mechanical pencil as set forth in claim 10, further comprising an act of attaching a spring with the slide member for forcing the slide member backwards after having been advanced by a user.

17. A method for forming a mechanical pencil as set forth in claim 10, further comprising an act of forming an eraser connector at the proximal end for attachment of an eraser.

18. A method for forming a mechanical pencil as set forth in claim 17, further comprising an act of attaching an eraser with the eraser connector.

* * * * *